US005237808A

United States Patent [19]

Gordon, Jr.

[11] Patent Number: 5,237,808

[45] Date of Patent: Aug. 24, 1993

[54] METHOD OF MANUFACTURING A COMPOSITE YARN

[75] Inventor: O. Lee Gordon, Jr., Browns Summit, N.C.

[73] Assignee: Unifi, Inc., Greensboro, N.C.

[21] Appl. No.: 809,769

[22] Filed: Dec. 18, 1991

[51] Int. Cl.[5] ..... D02G 1/02

[52] U.S. Cl. ..... 57/288; 57/208; 57/245

[58] Field of Search ..... 57/282, 284, 287, 289, 57/207, 208, 226, 245, 288

[56] References Cited

U.S. PATENT DOCUMENTS

| | | | |
|---|---|---|---|
| 3,401,516 | 9/1968 | Chidaey et al. | 57/245 |
| 3,807,162 | 4/1974 | Tsujita et al. | 57/152 |
| 3,921,382 | 11/1975 | Tsujita et al. | 57/226 X |
| 3,991,548 | 11/1976 | Toronyi et al. | 57/226 X |
| 4,162,607 | 7/1979 | Spivey | 57/287 |
| 4,296,597 | 10/1981 | Tani et al. | 57/226 X |
| 4,674,273 | 6/1987 | Clements et al. | 57/287 |

OTHER PUBLICATIONS

European Patent Application 90305285.0 filed May 16, 1990 (priority May 27, 1989) Applicant -Jones Stroud & Co. pub. Dec. 1990.

*Primary Examiner*—Joseph J. Hail, III

*Attorney, Agent, or Firm*—Rhodes, Coats & Bennett

[57] ABSTRACT

A method of composite yarn formed of a false twist crimped, heat set elastomeric core yarn intermingled with a false twist crimped, substantially heat set partially drawn, non-elastic yarn. The resulting composite yarn is substantially free of alternating "S" and "Z" twists, as well as voids. The composite yarn of the present invention is formed by increasing the number of turns per inch of the false twist and adjusting the operating conditions of the D/Y ratio, draw ratio of the elastic and non-elastic yarns, disc stacking, heat, and the machine speed to achieve a balanced or stable thread line.

5 Claims, 3 Drawing Sheets

METHOD OF MANUFACTURING A COMPOSITE YARN

BACKGROUND AND SUMMARY OF THE INVENTION

The present invention is directed to a composite yarn formed of an elastomeric yarn and a multifilament partially drawn non-elastic yarn and, more particularly, to a composite yarn formed by a process in which the partially drawn non-elastomeric yarn is friction twisted together with the elastomeric yarn during a false twisting operation under such conditions as to maintain a "stable" or "balanced" thread line. Fabrics and garments formed from such yarns have improved elasticity, stretch or comfort properties.

The term "elastomeric yarn", as used herein, is generally understood to mean a yarn having a high degree of stretch, for example, greater than 100% of the original length, which yarns are typically formed of polyurethane filaments, and generally referred to as "spandex". In the same manner, the term "non-elastomeric yarn", as used herein, generally refers to a yarn having a relatively low degree of stretch, e.g., less than 50% of the original length, and is typically formed of filaments of a firmer plastic polymeric material such as nylon or polyester as is generally used in the manufacture of plain or textured yarns. The terms "partially oriented", "partially drawn", and "incompletely drawn" yarns are all synonymous and are defined as filament yarns in which the draw ratio is less than normal resulting in only partial longitudinal orientation of the polymer molecules. Such yarns are only partially drawn by the fiber produced and hence must be finished before or during the texturizing process by the throwster. Composite yarns possessing elastic properties and consisting of elastomeric yarn associated with various types of non-elastomeric multifilament yarn are known in the art. Further, numerous prior art methods and apparatus have been proposed for forming composite yarns of the aforesaid general type.

At the outset, such composite yarns were formed by a wrapping process in which the non-elastomeric yarn wound on a bobbin mounted on a rotating hollow spindle is wound around the rubber or polyurethane elastic core filament as the elastic yarn is drawn through the hollow spindle. This process provides an excellent result, however, is extremely expensive and relatively slow. In accordance with a second process (referred to as "air entanglement"), the elastic core yarn is stretched and a plurality of substantially inelastic filaments are intermingled therewith by a pressurized fluid entangling means (air) to cover the yarn. While this process also results in an acceptable product, it is a process that is generally carried out separately from the texturizing process and, therefore, increases the cost of the resultant composite yarn.

U.S. Pat. Nos. 3,807,162 and 3,921,382 are both directed to a process for making a covered elastic yarn during the texturing process. An elastic core yarn and thermoplastic multifilament sheath yarns are supplied to a false twisting machine in parallel arrangement and subjected to a false twist crimping operation to entangle or intermingle the yarns. In these patents, the direction of twist of the sheath yarn about the core yarn is reversed irregularly and intermittently to provide a resultant yarn that is substantially twistless.

In a similar approach described in U.S. Pat. No. 3,991,548 to Toronyi et al. and a published European Patent Application No. 90305285.0, a composite yarn formed of a thermoplastic wrapping yarn is twisted around a spandex core yarn during a false twist operation in a series of alternating "S" and "Z" twists. In the approach of the European application, the thermoplastic wrapping yarn supplied to the process is a partially oriented yarn, which is completely drawn during the texturizing and twisting process. During the development of the processes described the European application, cohesion between the two yarns forming the composite yarn is a concern. Without adequate cohesion, fabrication of the resulting composite yarn in to woven or knit articles becomes extremely difficult, if not impossible. In order to provide sufficient cohesion, this approach, as part of the invention disclosed therein intentionally introduces parameters that result in "real twist" or permanent twist caused by an unstable or unbalanced thread line which includes a substantial number of lateral loops and voids. Such parameters as twist, D/Y ratio, heat, yarn draw tensions and machine speed were adjusted to achieve the resulting real twist (i.e., voids/tight spots). In the Toronyi et al. setup, the non-elastomeric yarn is undrawn nylon. As such, the setup only works with undrawn yarns because Toronyi et al. uses common feed rolls for both yarns and because undrawn nylon or undrawn yarns and spandex have approximately the same draw ratio.

While the aforedescribed processes have achieved some degree of acceptability in the market, there are some problems which have been noted. Primarily, the provision of real twist (intentional alternating "S" and "Z" twists) as a result of twist slippage results in loops which project laterally from the yarn and voids. Lateral loops and voids form sections of yarn which are objectionable during later processing into fabric and garments. For example, in sheerer fabrics the loops/voids cloud the appearance and increase the likelihood of picks. While Toronyi et al. apparently provides a composite yarn without real twist, it does not provide a technique for accomplishing such a result where the non-elastomeric yarn is partially drawn.

In the present invention, on the other hand, a different approach is taken. Applicants have discovered that by increasing the inserted twist (false twist) to a t.p.i. in the range of 160–200, and adjusting the yarn processing conditions, a more uniform yarn can be formed with a stable thread line (i.e., without alternating "S" and "Z" twists which result in lateral loops and voids). Thus, such objectionable "real twist" is essentially eliminated, or at least minimized. Such variable processing conditions which may be adjusted include disc stacking, draw ratios, D/Y ratio, heat, and speed. While the elastomeric core yarn and partially oriented non-elastomeric yarn of the present invention are both supplied to the heater and false turns section under tension, the twist per inch is greater (160–200 t.p.i.). In order to accomplish this result, adjustments in yarn draw tensions, D/Y ratio, heat, and disc configuration are also adjusted. The resulting yarn, because of the absence of lateral loops, may be knit at increased speeds and reduced tension which improves knitting efficiencies and results in a more uniform fabric. It is also believed that the composite yarn speed through the texturizing machine may be increased to the range of 570–800 meters per minute, resulting in further economies. Further, the higher inserted false twist results in proper cohesion substantially without voids and lateral loops and improves the fabric appearance.

It is therefore an object of the present invention to provide an improved method for manufacturing a composite yarn of the type which comprises an elastomeric yarn cohesively intermingled with an non-elastomeric multifilament in such a manner as to exhibit a stable thread line and minimal real twist.

It is a further object to provide a composite yarn which comprises an elastomeric yarn cohesively intermingled with a non-elastomeric, multifilament yarn, the composite yarn having a stable thread line and having improved processing characteristics when knit or woven into a fabric.

Other objects and a fuller understanding of the invention will become apparent by reading the following detailed description of a preferred embodiment along with the accompanying drawings in which.

DETAILED DESCRIPTION OF A PREFERRED EMBODIMENT

Figure 2:
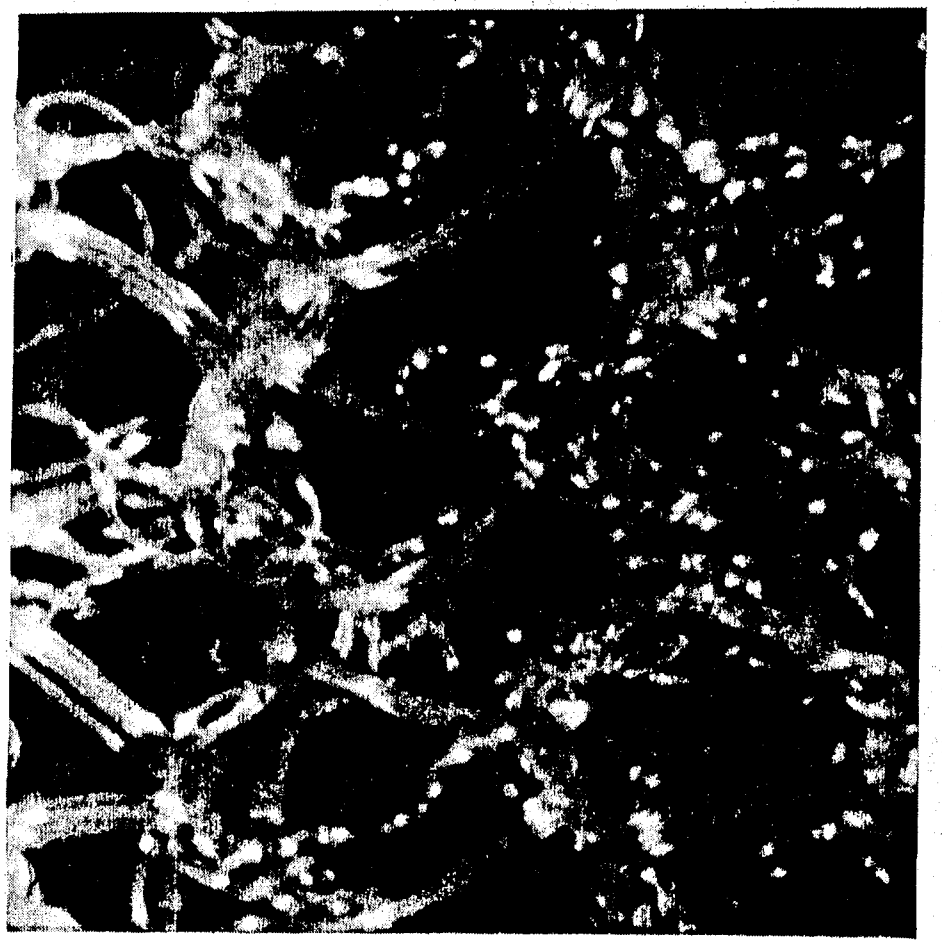
FIG. 2 PRIOR ART
FIG. 2 is a schematic view of a section of fabric processed with composite yarn formed in accordance with prior art techniques.
Figure 1:
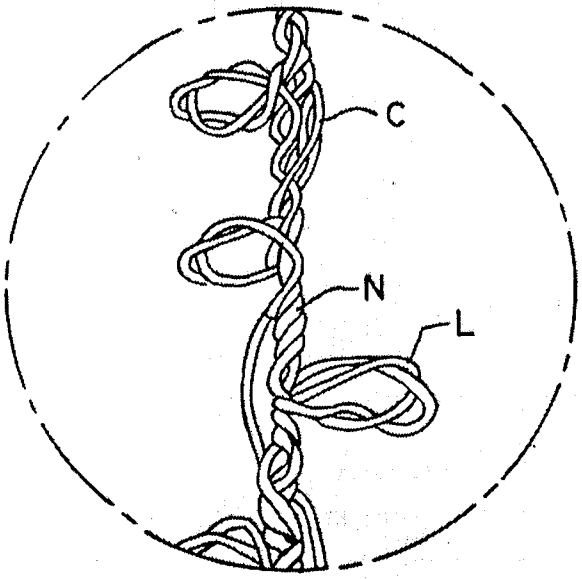
FIG. 1 PRIOR ART
FIG. 1 is a schematic view of a length of covered elastic yarn as processed by prior art techniques.

Referring first to FIGS. 1 and 2, there is illustrated schematically a composite yarn C prepared in accordance with the prior techniques. As can be seen, the finished composite yarn C includes non-elastomeric, partially drawn multifilament strands N which from alternating "S" and "Z" twists around the spandex core yarn (not shown at points where "S" twists change to "Z" twists and vice versa). There results loops L which project laterally from the body of the composite yarn as a result of changes in the twist direction. Such laterally extending loops L and voids of texture which have a tendency to create slubs which adversely effect the appearance, particularly in sheer fabrics, as well as enhancing the likelihood of picks.

Figure 4:
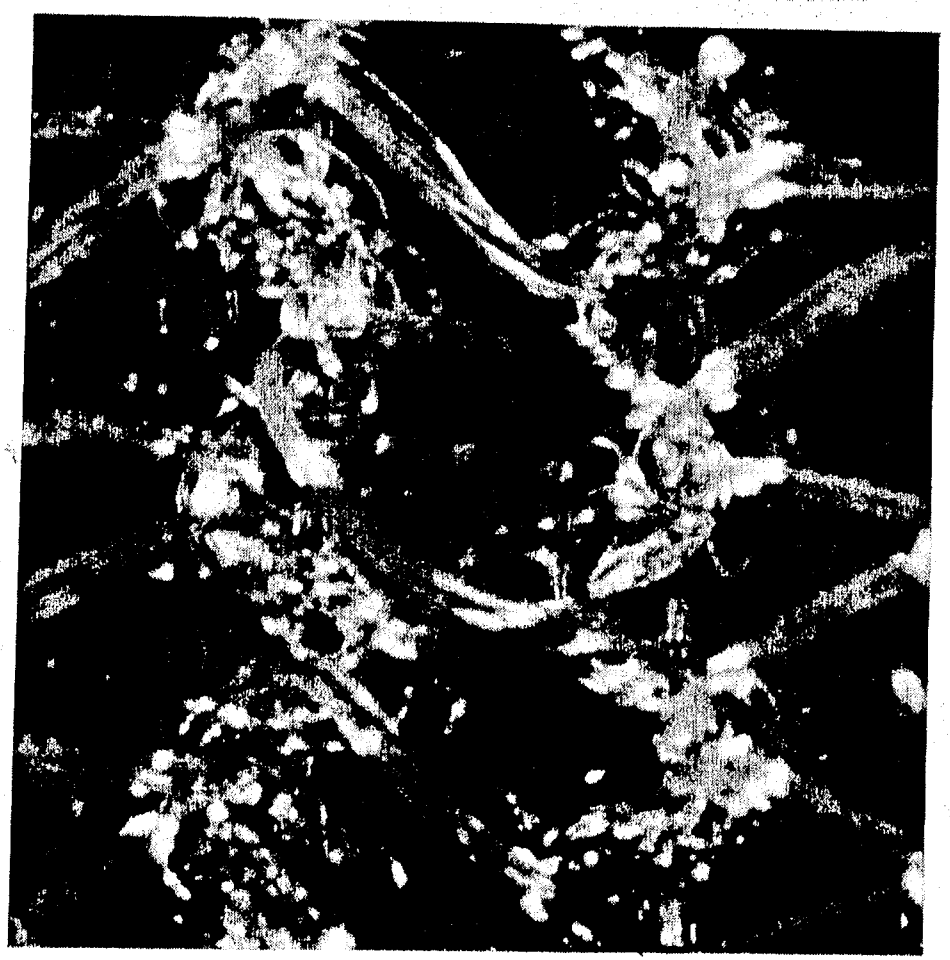
FIG. 4 PRIOR ART
FIG. 4 is a schematic view of a section of fabric formed of yarn processed in accordance with the present invention.
Figure 3:
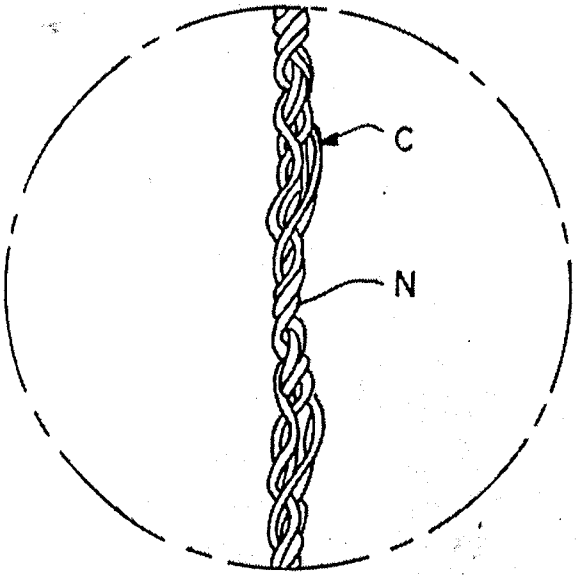
FIG. 3 is a schematic view of a length of yarn formed in accordance with the present invention.

In FIGS. 3 and 4 and by comparison, the yarn of the present invention is schematically illustrated. As can be seen, the number of alternating "S" and "Z" and lateral extending loops is greatly diminished. It is believed that considerable advantages result from this improved yarn, which advantages have been described in detail hereinabove.

Figure 5:
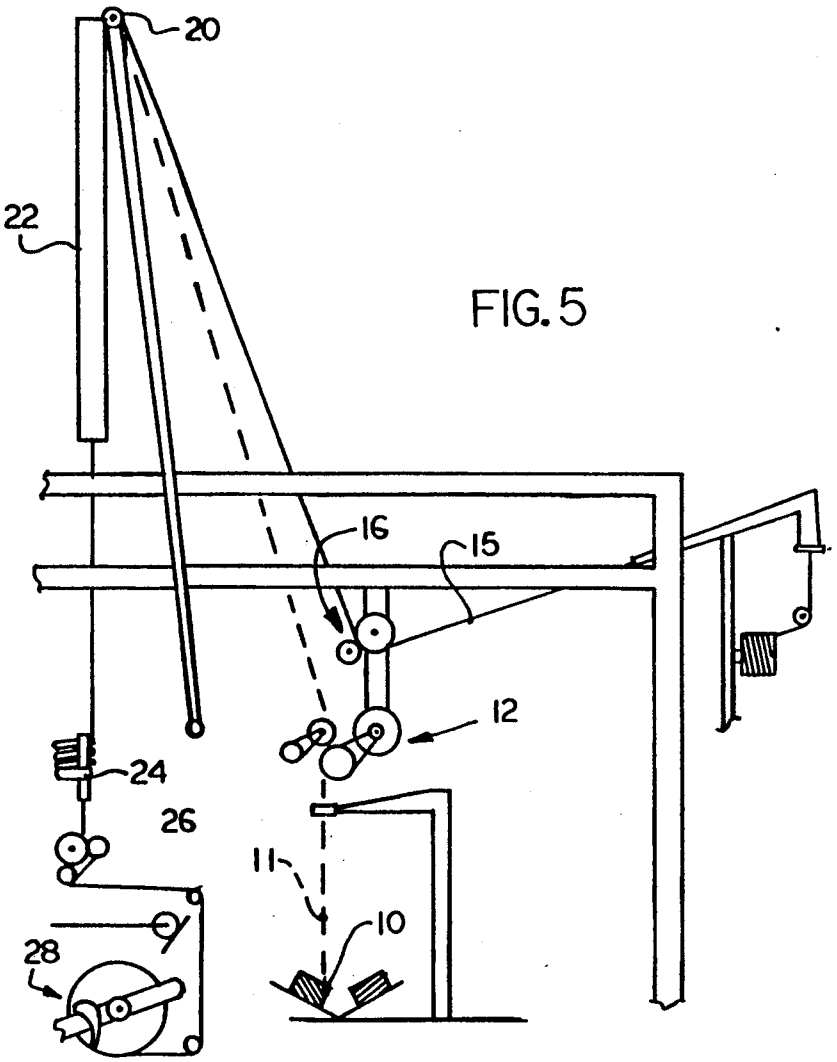
FIG. 5 is a schematic view of a false-twisting apparatus, shown partially in cross-section, which can be used to form the yarn in accordance with the present invention.

Turning now to FIG. 5, spandex yarn 11 (draw ratio 2.5–3.0), typically Lycra (Registered Trademark), is stored on a package 10 and removed over the end thereof by a first feed roller 12 at a first speed, typically 192 meters per minute, to a guide 20. Partially drawn nylon 15 (having a draw ration of approximately 1.4) is stored on a package 14 and removed over the end thereof by a second feed roller 16 at a second speed, typically 362 meters per minute to the same guide 20.

From the guide 20, the nylon and spandex are fed diagonally downwardly across the surface of a heater 22 and into a crimping or false twist device 24 in the form of a stack of friction disks. As the yarns pass through the heater 22 and the false twist device 24, they are simultaneously heated and false twisted. A third driven roll or or driven roll device 26 is located downstream of the friction disks 24 and operates at a third speed, typically 500 meters per minute. The third speed is greater than either the first speed at which the spandex yarn is driven or the second speed at which the partially oriented nylon is driven. Because of the higher third speed, the partially oriented nylon yarn is drawn to orient the fibers therein during the heating and false twisting thereof. The composite yarn, which has then been drafted, heated, and twisted, is then collected on a take-up package 28.

The above described arrangement of machine elements is not unique, however, it is the manner in which the machine elements are operated in cooperation to achieve a stable thread line, rather than alternating "S" and "Z" twists in the resulting yarn, that is significant. As described earlier, in accordance with the present invention, the goal of achieving a cohesive composite yarn substantially devoid of lateral loops and void areas (also referred to as a balanced thread line or lack of real twist) is achieved by adjusting several parameters. First of all, the problem of achieving cohesion between the two yarns while maintaining a balanced line is addressed by increasing the number of turns per inch. Normally, to increase the turns per inch, the D/Y ratio is increased, however, that is not the approach adopted in the present invention. Rather, the D/Y ratio is actually decreased to approximately 1.6. D/Y ratio is the relationship between the surface speed of the friction discs (discs that insert twist into the yarn) as compared to the yarn throughout speed (machine speed). This ratio is calculated according to the following formula:

$$D/Y = \frac{\text{disc speed (rpm)} \times \pi \times \text{disc diameter (meters}}{\text{machine throughput speed (meters per minute)}}$$

However, the draw ratio of the spandex is decreased considerably and the draw ratio of the non-elastomeric yarn is increased slightly. (Spandex draft and nylon draw will vary depending on yarn type.)

Figure 6:
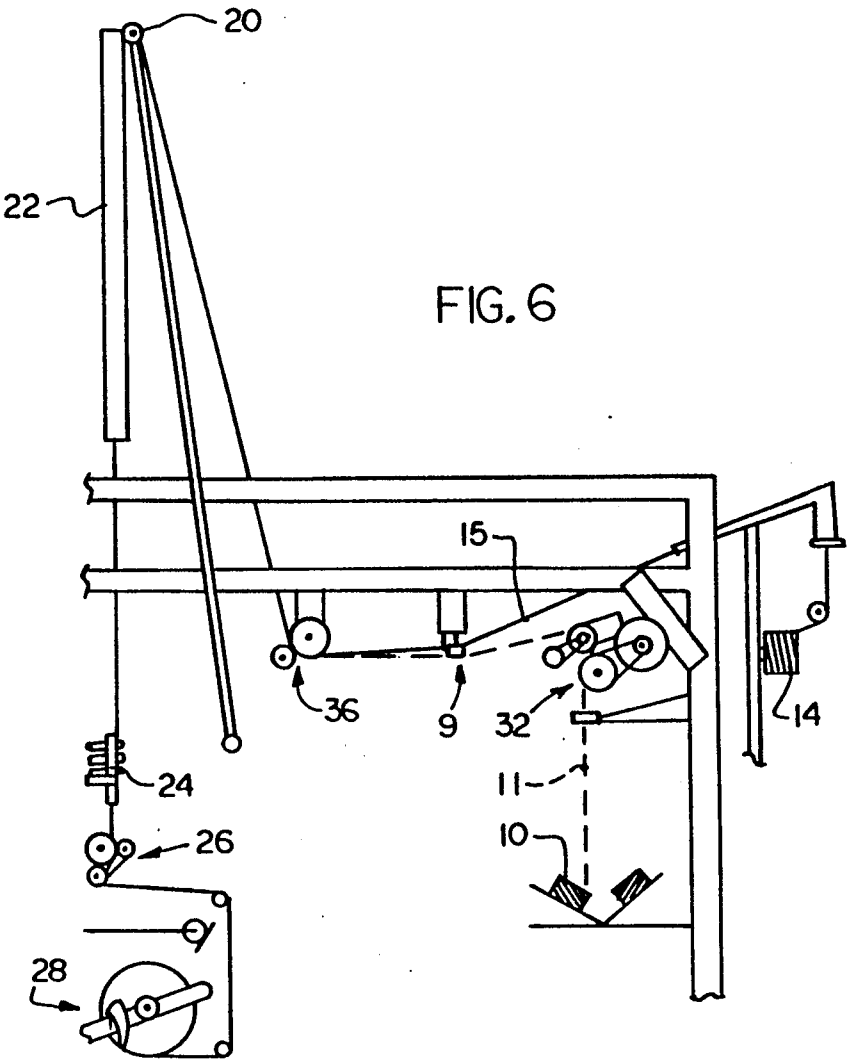
FIG. 6 is a schematic view of a false-twisting apparatus similar to that illustrated in FIG. 5, except showing an alternative approach of forming the yarn in accordance with the present invention.

In FIG. 6, an alternative setup is illustrated which differs from the arrangement of FIG. 5 in the manner in which the two yarns 11 and 15 are fed to the false twist device 24. In FIG. 6, a first feed roll 32 removes spandex yarn 11 from package 10 at a speed of approximately 192 meters per minute and delivers the spandex yarn 11 to a second feed roll 36 where it joins yarn 15. The two yarns 11 and 15 are then delivered at the same speed (362 meters per minute) through heater 22 and into the false twist device 24. Thus, the spandex speed between feed rolls 36 and 32. Later the spandex yarn 11 and the nylon yarn 15 are fed together under the same second tension into the false twist device.

Examples 1 and 2

In the following table 1, the processing parameters of a yarn treatment setup according to the present invention on a Barmag machine setup (FIG. 5) are compared with a yarn treatment setup on a Scragg machine setup operated in accordance with the comparable parameters as described in the afore-identified European Patent Application No. 90305285.0:

TABLE 1

| | European Patent Appln. | Present Invention |
|---|---|---|
| Machine speed, mm | 550 | 500 |
| False Twist- turns per inch | 127–152 | 170 |
| D/Y Ratio | 1.8 | 1.6 |
| Spandex yarn speed, mm | 125 | 192 |
| Nylon yarn speed, mm | 385 | 362 |
| P.O.Y. draw ratio | 1.3 | 1.36 |
| Spandex draw ratio | 4.0 | 2.6 |
| Heater temperature (°C.) | 150 | 150 |

As a result of the test described hereinabove, the arrangement according to the European application provided a yarn (Example 1) that, as anticipated, included lateral loops extending therefrom, a considerable number of voids, and alternating "S" and "Z" twists (real twist). The yarn was formed into stockings and a high number of picks resulted. "Picks" are loops of yarn extending outwardly from a fabric surface which creates dark sections in an otherwise sheer background. Picks are measured by a special pick testing machine developed by the assignee of the present invention in 1986. On stockings produced on two separate occasions from the yarn formed according to the setup described in the prior art European application, approximately 700 picks per dozen pairs of stockings were noted. In the yarn produced by the process according to the present invention (Example 2), there were substantially no lateral loops extending therefrom and substantially no voids therein (see FIGS. 3 and 4). The yarn was substantially devoid of alternating "S" and "Z" twists and still with good cohesion between the yarns resulted. Further, stockings formed from the yarn according to the present invention had an improved appearance in that there were no cloudy areas, which are a result of the lateral loops. Also a significant reduction (>50%) of picks per dozen were noted (285–315).

Overall, the results of the testing show that it is preferable to not form alternating "S" and "Z" twists or voids in a composite yarn in order to achieve proper cohesion. Rather, proper cohesion can be formed in a yarn having a stable thread line with a higher twist therein.

Examples 3–5

In the following table 2, the parameters for additional examples 3–5 are described. In these examples machine speed, D/Y ratio, Spandex and nylon yarn speeds and draw all remain constant while the heater temperature varies. All three examples achieved a twist result greater than 160 turns per inch and a stable thread line similar to that realized in Example 2:

TABLE 2

| | Example | | |
|---|---|---|---|
| | 3 | 4 | 5 |
| Machine Speed m/m | 570 | 570 | 570 |
| Twist - tpi | >160 | >160 | >160 |
| D/Y Ratio | 1.6 | 1.6 | 1.6 |
| Spandex Yarn Speed m/m | 219 | 219 | 219 |
| Nylon Yarn Speed m/m | 420 | 420 | 420 |
| P.O.Y. Draw Ratio | 1.36 | 1.36 | 1.36 |
| Spandex Draw Ratio | 2.6 | 2.6 | 2.6 |

TABLE 2-continued

| | Example | | |
|---|---|---|---|
| | 3 | 4 | 5 |
| Heat Temperature (°C.) | 135 | 150 | 165 |

Examples 6 and 7

In examples 6 and 7 machine speed, D/Y ratio, nylon yarn speed and draft, and temperature were held constant, while Spandex yarn speed and draw were adjusted as evidenced in Table 3. In Example 7, a high twist (>160 tpi) and a stable thread line were achieved with a minimal number of lateral loops and voids, as well as a low number of picks. However, the yarns of Example 6 would not successfully run through the false twist machine.

TABLE 3

| | Example | |
|---|---|---|
| | 6 | 7 |
| Machine Speed m/m | 570 | 570 |
| Twist - tpi | >160 | >160 |
| D/Y Ratio | 1.6 | 1.6 |
| Spandex Yarn Speed m/m | 285 | 203 |
| Nylon Yarn Speed m/m | 420 | 420 |
| P.O.Y. Draw Ratio | 1.36 | 1.36 |
| Spandex Draw Ratio | 2.0 | 2.8 |
| Heat Temperature (°C.) | 165 | 165 |

Example 8

In Example 8 (Table 4), a high processing speed (800 m/m) was selected. The spandex and nylon yarn speeds were both increased as illustrated in Table 4. The attempt to form a composite yarn using these parameters was unsuccessful.

TABLE 4

| | Example 8 |
|---|---|
| Machine Speed m/m | 800 |
| Twist - tpi | >160 |
| D/Y Ratio | 1.6 |
| Spandex Yarn Speed m/m | 306 |
| Nylon Yarn Speed m/m | 588 |
| P.O.Y. Draw Ratio | 1.36 |
| Spandex Draw Ratio | 2.6 |
| Heat Temperature (°C.) | 150 |

Examples 9–12

In Examples 9–12 (Table 5), a moderate machine speed (570 m/m), and constant Spandex and nylon speeds and draw. Only the D/Y ratio varied. In the yarns of Examples 9 and 10, a much higher D/Y ratio was utilized, and a number of core cuts were noticed with the result that the composite yarn was unsatisfactory. In Examples 11 and 12, the D/Y ratio was reduced, but excessive voids were still noticed.

TABLE 5

| | Example | | | |
|---|---|---|---|---|
| | 9 | 10 | 11 | 12 |
| Machine Speed m/m | 570 | 570 | 570 | 570 |
| Twist - tpi | >160 | >160 | >160 | >160 |
| D/Y Ratio | 2.22 | 2.42 | 2.00 | 1.80 |
| Spandex Yarn Speed m/m | 219 | 219 | 219 | 219 |
| Nylon Yarn Speed m/m | 420 | 420 | 420 | 420 |
| P.O.Y. Draw Ratio | 1.3 | 1.36 | 1.36 | 1.36 |

TABLE 5-continued

| | Example | | | |
|---|---|---|---|---|
| | 9 | 10 | 11 | 12 |
| Spandex Draw Ratio | 2.6 | 2.6 | 2.6 | 2.6 |
| Heat Temperature (°C.) | 135 | 135 | 135 | 135 |

Thus it can be seen that the relative high twist and stable thread line can be obtained by varying different operating conditions. When the machine speed is higher, it would appear that both spandex and nylon speeds should be increased. Also it should be recognized that spandex and nylon draw ratios are a function of machine speed, spandex speed, and nylon speed.

While a preferred embodiment of the present invention has been shown and described in detail hereinabove, it is apparent that various changes and modifications might be made to the present invention without departing from the scope thereof. The scope of the invention should therefore be limited only by the following claims:

What is claimed is:

1. An improved method of manufacturing a composite yarn of the type comprising a false-twist crimped, heat-set, elastomeric yarn entangled with a false-twist crimped, heat-set, incompletely drawn, non-elastomeric, multi-filament yarn to achieve cohesion between the two yarns comprising the steps of:

a) feeding said elastomeric yarn and said incompletely drawn, non-elastomeric yarn through a draw zone under tension and while temporarily stretching the elastomeric yarn to a first draw ratio in the range of 2.0–3.0 and drawing the incompletely drawn, non-elastomeric yarn to a second draw ratio in the range of 1.25–1.46;

b) inserting false twist by friction-twisting the elastomeric yarn and the non-elastomeric yarn in said draw zone, wherein the turns per inch of the yarn being twisted is in the range of 160–200 turns per inch;

c) heating the yarns in the draw zone to a temperature sufficiently high to adequately set the twist, but below that at which the elasticity of said elastomeric yarn would be destroyed;

d) setting the operating conditions of the false twist operation to achieve a balanced thread line to provide a composite entangled resultant yarn substantially free of real twist sections.

2. The method according to claim 1 and further wherein the operating conditions of step (d) are adjusted include D/Y ratio, the machine speed, and the heat of the draw zone.

3. The method according to claim 2 wherein the D/Y ratio is in the range of 1.5 to 2.5.

4. The method according to claim 2 wherein said first and second draw ratios are achieved by:

a) before the heating step feeding said elastomeric yarn substantially 192 m/m and feeding said elastomeric yarn from said first guide roll and said incompletely drawn non-elastomeric yarn to a second guide roll driven at 362 m/m; and b) during said heating step feeding said elastomeric yarn and incompletely drawn non-elastomeric yarn through a heater and twisting head to a third guide roll located downstream of said heater and driven at substantially 500 m/m.

5. The method according to claim 1 wherein both the elastomeric yarn and the incompletely drawn, non-elastomeric yarn are delivered over the end of the package.

* * * * *